United States Patent [19]

Matsuda

[11] Patent Number: 4,575,352

[45] Date of Patent: Mar. 11, 1986

[54] TOY GUN CONVERTIBLE INTO ROBOT-HUMANOID FORM

[75] Inventor: Takashi Matsuda, Tokyo, Japan

[73] Assignee: Takara Co., Ltd., Tokyo, Japan

[21] Appl. No.: 584,461

[22] Filed: Feb. 28, 1984

[30] Foreign Application Priority Data

Jun. 15, 1983 [JP] Japan ..... 58-91864[U]

[51] Int. Cl.[4] ..... A63H 3/46; A63H 33/30

[52] U.S. Cl. ..... 446/376; 446/473; 446/487

[58] Field of Search ..... 446/473, 72, 85, 97, 446/99, 268, 320, 376, 487

[56] References Cited

U.S. PATENT DOCUMENTS

| | | | |
|---|---|---|---|
| 3,453,774 | 7/1966 | Breneman et al. | 446/353 |
| 3,938,277 | 2/1976 | Goldfarb et al. | 446/384 |
| 3,946,517 | 3/1976 | Goldfarb et al. | 446/383 |
| 4,103,451 | 8/1978 | Kawada et al. | 446/99 |
| 4,150,508 | 4/1979 | Ogawa | 446/473 X |
| 4,206,564 | 6/1980 | Ogawa | 446/99 X |
| 4,391,060 | 7/1983 | Nakane | 446/97 X |
| 4,411,097 | 10/1983 | Murakami | 446/376 |

*Primary Examiner*—Mickey Yu

*Attorney, Agent, or Firm*—Price, Gess & Ubell

[57] ABSTRACT

A combination toy gun and robot assembly is provided. The toy gun has a handle member, cylinder member, gun barrel member, and trigger assembly. Each of these elements can be relatively movable to change from the simulation of a gun into a position of that of a robot in a second position. A robotic head member can be positioned to complete the robotic form toy. The gun barrel member can form one arm or the cylinder member forms another arm of the robot, and the handle member can be bifurcated to form the legs.

9 Claims, 14 Drawing Figures

TOY GUN CONVERTIBLE INTO ROBOT-HUMANOID FORM

BACKGROUND OF THE INVENTION

1. Field of the Invention

The present invention relates to a reconfigurable toy gun robotic-humanoid assembly which can reconfigure its shape simulating a gun such as a pistol or the like into the shape of a robotic humanoid.

2. Description of the Prior Art

Hitherto, such a reconfigurable toy assembly has been known that is adapted to be reconfigurable into different kinds of shape through combination of block members. However, if such a toy assembly is complicated in construction so as to allow a unique structure to be enjoyed, the toy assembly becomes difficult for infants to handle, to make impossible to elicit the interest thereof. On the other hand, if the construction is simplified, the toy becomes monotonous, which also makes difficult to interest infants therein. In addition, any loss of the block members makes impossible to form a predetermined shape and it is troublesome to take care that any of the block members is not lost. Thus, the conventional reconfigurable toy assembly is unfavorable for infants.

SUMMARY OF THE INVENTION

The present invention provides, in a toy gun robotic-humanoid assembly having various parts which constitute the configuration of a gun when folded and constitute the configuration of a robotic humanoid when unfolded, a toy gun having a gunbarrel with a muzzle, and a gunstock provided with a rear sight, a cylinder, and a grip, the toy gun comprising, so as to be able to take a robotic humanoid configuration when unfolded: the gunbarrel foldably provided so as to constitute one of robotic humanoid arms; the cylinder adapted to constitute a robotic humanoid breast and drawably fitted with a core member; the core member adapted to be foldable so as to constitute the other robotic humanoid arm; the grip pivotally attached so as to be splitable and unfoldable into two parts to constitute a pair of robotic humanoid legs; and the rear sight slidably as well as rotatably mounted on the gunstock so as to constitute a robotic humanoid head.

The object and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DETAILED DESCRIPTION OF THE PREFERRED EMBODIMENT

A toy revolver in accordance with an embodiment of the invention will be described hereinunder with reference to the accompanying drawings.

Figure 1:
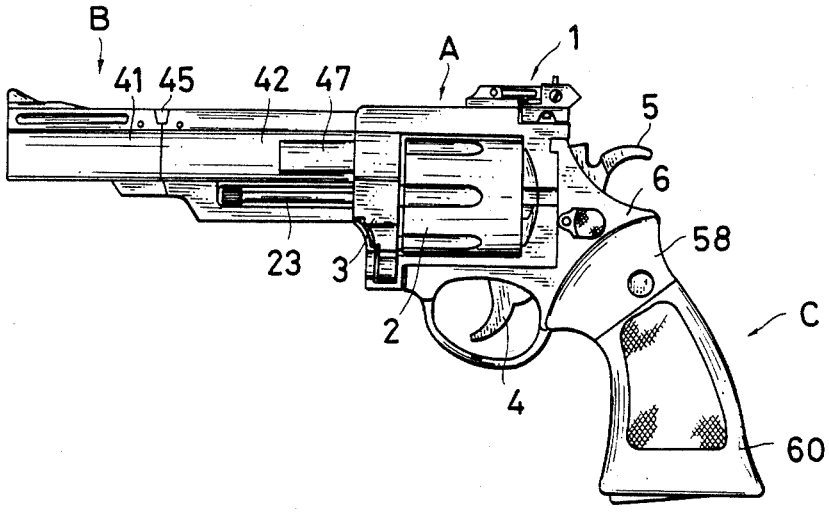
FIG. 1 is a side elevational view of an embodiment of the present invention.
Figure 2:
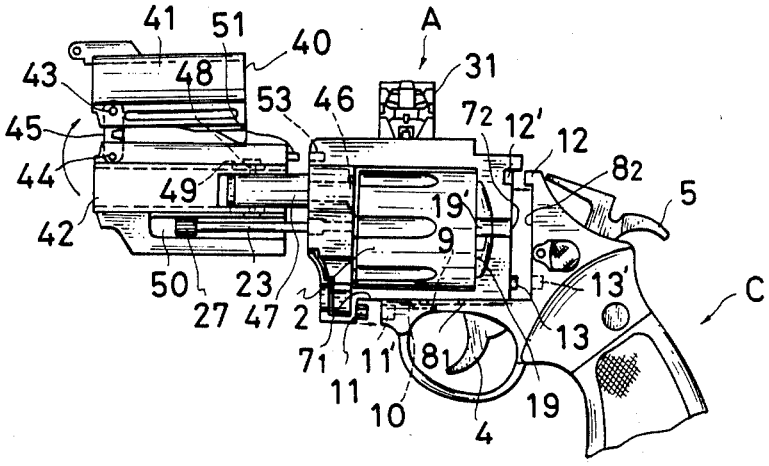
FIG. 2 is a partial side elevational view of the embodiment of FIG. 1 in a disjoined state.
Figure 3:
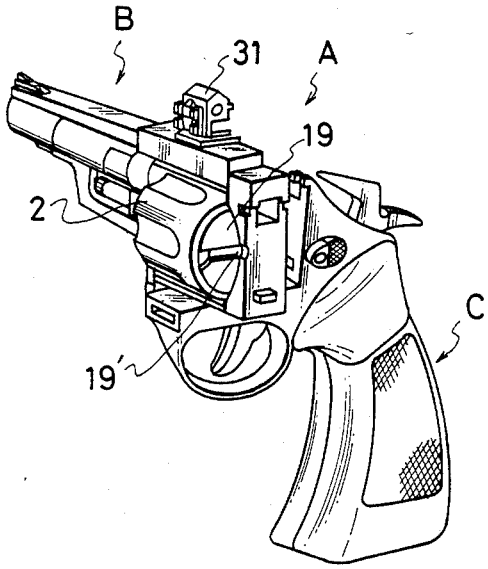
FIG. 3 is a perspective view of the embodiment of the FIG. 1 with a gunstock section rotated.

Referring to FIGS. 1 to 3, a gunstock A is composed of: a cylinder supporting member 3 which has a rear sight 1 provided on its top surface and a cylinder 2 housed in its hollow part; and an L-shaped operating part supporting member 6 provided with a trigger 4 and a hammer 5 and is connected to the gun handle, as shown in FIG. 1. The supporting member 6 extends forward under the cylinder 2. These members are adapted to be slidable between abutment surfaces $7_1$, $8_1$ and pivotal about a connecting shaft 9, as shown in FIGS. 2 and 3.

More specifically, a guide slot 10 is formed in the abutment surface $8_1$ of the operating part supporting member 6, and the end portion, having a coming-off preventing stopper, of the connecting shaft 9 projected from the abutment surface $7_1$ of the cylinder supporting member 3 is inserted into the guide slot 10 thereby to connect the members 3 and 6.

As shown in FIG. 2, reference numerals 11, 11' denote a fitting projection and recess formed on the abutment surfaces $7_1$, $8_1$, respectively, while numerals 12, 12', 13, 13' represent fitting projections and recesses formed on abutment surfaces $7_2$, $8_2$, respectively.

As shown in FIG. 3, covers 19 for covering side surfaces of the cylinder 2 is provided with a notch 19' for loading a bullet. Further, a projection 80 shown in FIG. 5 is urged outwardly by a spring (not shown) which is provided at the midpoint of the cover 19 for connecting a recess 26 of the cylinder 2, described hereinafter, when the toy gun assembly is in the pistol configuration.

Figure 4:
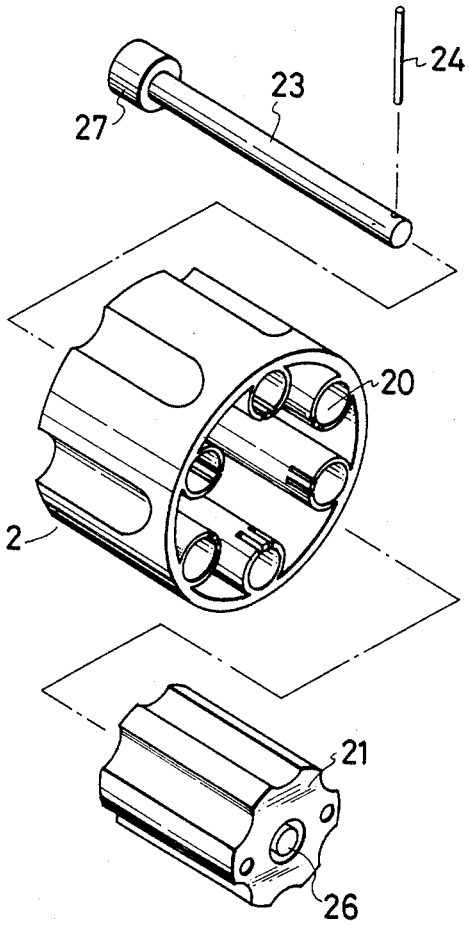
FIG. 4 is an exploded perspective view of the cylinder.
Figure 6:
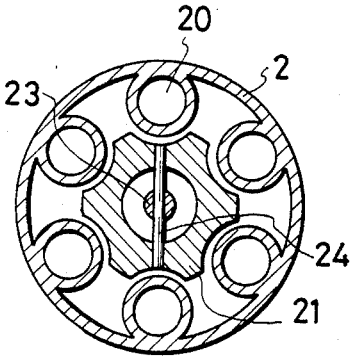
FIG. 6 is a sectional view taken along the line VI—VI of FIG. 5.
Figure 5:
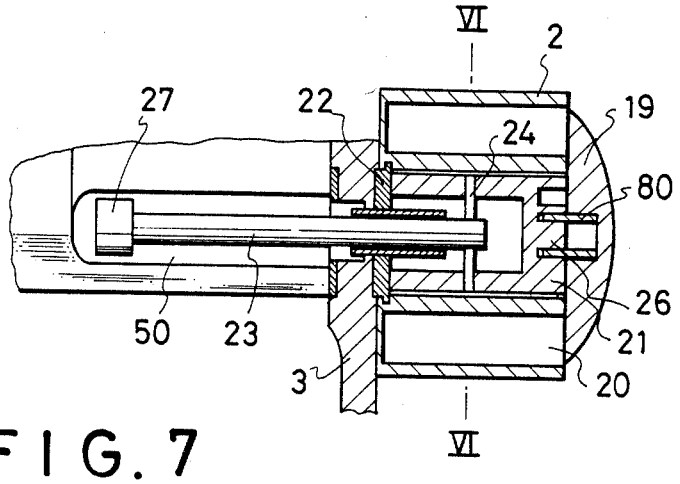
FIG. 5 is a longitudinal sectional view of a cylinder of the present invention.
Figure 12:
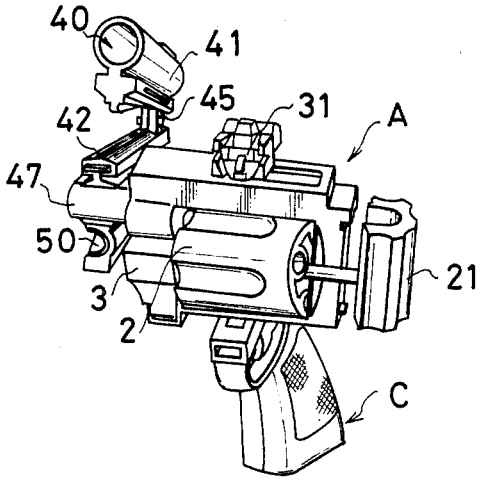
FIG. 12 is a perspective view of the embodiment in the midst of a reconfiguration.

Referring to FIGS. 4 to 6, the cylinder 2 is constituted by a cylindrical body which has a hollow portion and bullet housing bores 20 formed therethrough and is rotatably mounted on the cylinder supporting member 3. The hollow portion of the cylinder 2 has a cylindrical core member 21 with a side opening at one end, see FIG. 12, drawably housed therein. More specifically, in the case of a revolver type of gun in which the cylinder 2 houses six bullets, the cylinder 2 is supported by a fixed hollow shaft 22 through an engaging surface portion which has a hexagonal cross-section and is guided so as to effect a 60° intermittent revolution by a guide means which is not shown in the drawings.

As shown in FIGS. 5 and 6, the core member 21 is adapted to be housed in the cylinder 2 through a fitting between uneven engaging surfaces which are constituted by the inner peripheral surface of the cylinder 2 and the outer peripheral surface of the core member 21, so as to revolve with the revolution of the cylinder 2 about the fixed shaft 22 as one unit.

Moreover, the core member 21 is constituted by a trough-like member which is connected to the support shaft 23 through a connecting shaft 24 so as to be able to revolve through both the support shaft 23 and the connecting shaft 24. The support shaft 23 is supported by the cylinder supporting member 3 while extending therethrough so as to be slidable as well as rotatable about its own axis, as shown in FIG. 6.

In FIG. 4, reference numerals 26 denote a recess for connecting an attachment, described hereinafter. The recess 26 is fitted by the projection 80 so as to serve also as a shaft for supporting the cylinder 2 when the assembly is in the pistol state. A reference numeral 27 represents a cap provided at an end of the support shaft 23 for preventing the core member 21 from coming off.

Figure 7:
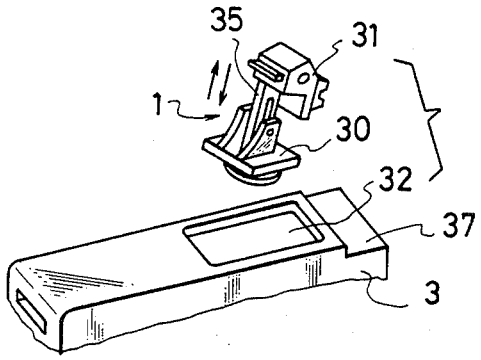
FIG. 7 is a perspective view of a rear sight in a separated state.
Figure 8:
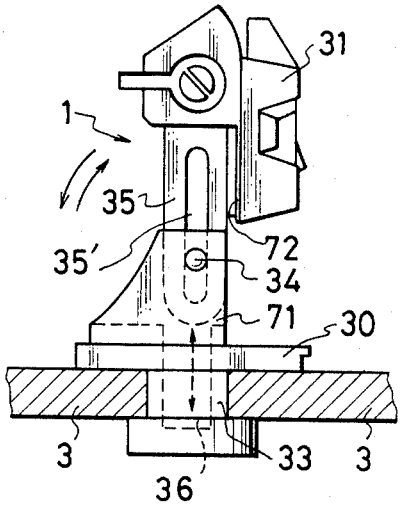
FIG. 8 is a side elevational view of the rear sight in an unfolded state.

Referring to FIGS. 7 and 8, the rear sight 1 is constituted by a slide piece 30 which is slidable in a guide bore 32 provided in the top surface of the cylinder supporting member 3 and has a robotic humanoid head 31 which is connected to the slide piece 30 so as to be rotatable as well as pivotal vertically.

More specifically, a connecting shaft 33, which slides along a guide bore 32 formed in the top surface of the supporting member 3 while being prevented from coming off, is provided so as to extend beyond the undersurface of the slide piece 30. In addition, the robotic humanoid head 31 and the slide piece 30 are connected through a link 35 having a shaft 34 and a slot 35'. The connecting shaft 33 has a recess 36 formed therein which can receive the link 35 by a predetermined length, as shown in FIG. 8. Further, the robotic humanoid head 31 is provided on the gunstock section A so as to be able to pivot (for burying and exposing the face), slide, rotate as well as come in and out of contact (when the face is exposed) with respect to the cylinder supporting member 3.

In FIGS. 7 and 8, a reference numeral 37 denotes a notch for receiving the face of the robotic humanoid head 31 when the assembly is in the gun state, and a numeral 71 represents a bearing for the shaft 34 which is adapted to fit in a surface 72 formed in the rear side of the robotic humanoid head 31.

Referring to FIG. 2, the gunbarrel section B is composed of a front-side member 41 and a base-side member 42. These members 41, 42 are connected through a connecting member 45 connected to both the members through shafts 43, 44, respectively, so that the members 41, 42 can be folded together, as shown in FIG. 2.

The base-side member 42 is rotatably and slidably connected to a base 47, which is rotatably mounted on the cylinder supporting member 3 through a shaft 46, through a shaft 48 and a slot 49 along which the shaft 48 slides. In addition, the base-side member 42 is provided with a guide bore 50 for the support shaft 23 so as to receive the support shaft 23 projecting from the core member 21 through the cylinder supporting member 3 when the assembly is in the pistol state.

In the drawings, a reference numeral 51 denotes a projection which is provided at the end portion of the base-side member 42. Moreover, a numeral 53 denotes a recess formed in the supporting member 3 for fitting with the projection 51.

Figure 9:
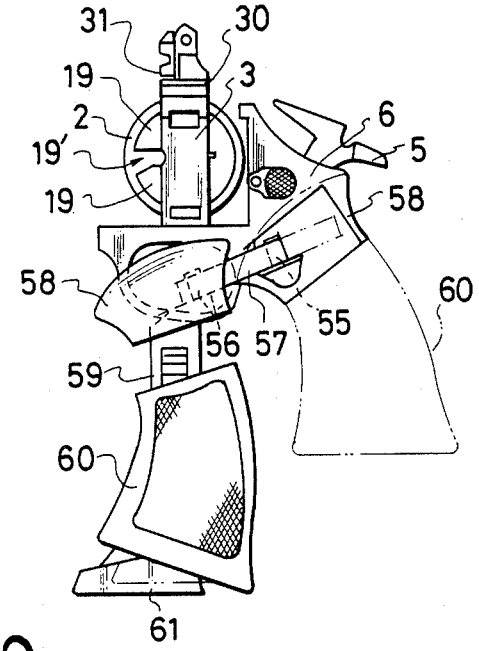
FIG. 9 is a side elevational view of the embodiment of the present invention in the midst of a reconfiguration.
Figure 10:
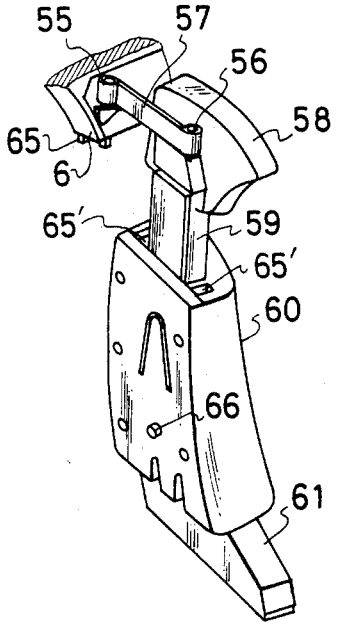
FIG. 10 is a perspective view of a grip section of the embodiment in a disjoined state.

Referring to FIGS. 9 to 10, the operating part supporting member 6 equipped with the trigger 4 and the hammer 5 according to a known construction, which permits percussion, has the grip section C connected thereto so that it can come in and out of contact with the supporting member 6, as shown in FIG. 9.

The grip section C is composed of: a pair of covers 58, 58 which are provided on both sides of the supporting member 6 through a link 57 so as to be able to come in and out of contact with the supporting member 6; and grip bodies 60 which are connected to the covers 58, 58 through connecting members 59 so as to be able to come in and out of contact with the covers 58, 58, respectively. These bodies 60, 60 are constituted by hollow cylindrical members, respectively, and are adapted to form a single grip with their opposing surfaces abutting on each other. Each body 60 has in its upper inside a sliding bore for the corresponding connecting member 59 and is provided in its lower inside with a portion for receiving a robotic humanoid foot 61 as well as has the robotic humanoid foot 61 so that it can be projected and withdrawn as desired, as shown in FIG. 11.

Each of the bodies 60, the connecting member 59 and the feet 61 is provided with fitting portions which are not shown in the drawings for preventing coming off and for shape retention (prevention of any undesirable depression) under a given projecting state when the assembly is in the robotic humanoid state. The fitting portions for the latter are constructed such that one of a pair of fitting portions is constituted by a side panel portion constituted by a spring leaf so that the application of a force more than a given value undoes the fitting thereby allowing one to be received by another. In addition, the slide portion of each foot 61 is constituted by a guide bore and a pin so as to be slidably as well as pivotally projected and withdrawn.

Figure 11:
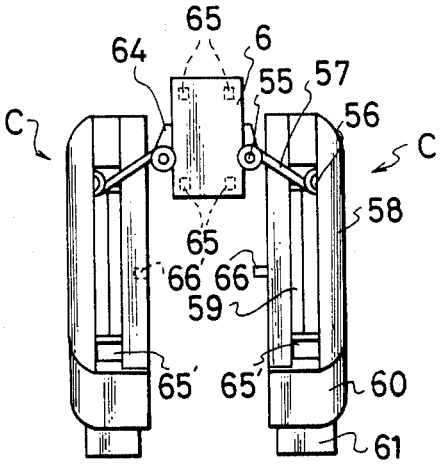
FIG. 11 is a plan view of the grip section of the embodiment.

In FIG. 11: a reference numeral 64 denotes each of projections for regulating the corresponding link 57; numerals 65, 65' represent a fitting projection formed on the supporting member 6 and a fitting recess formed in each body 60, respectively; and numerals 66, 66' denote fitting projections and recesses formed on the bodies 60, 60.

Figure 14:
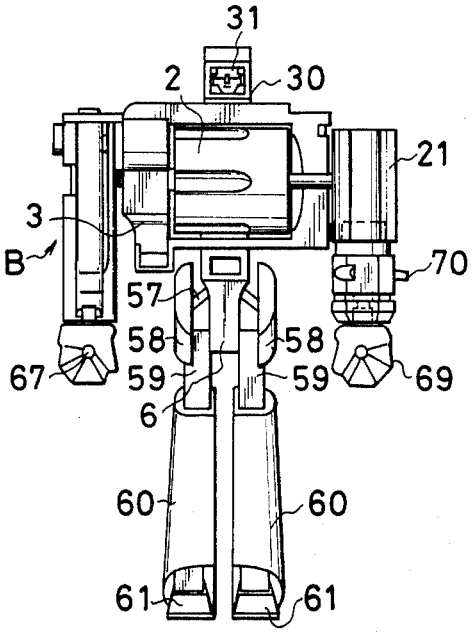
FIG. 14 is a front elevational view of the embodiment in the unfolded state.

As accessories, a right hand 67, a left forearm portion 68 and a left hand 69 are properly employed through connections, and the left hand 69 is adapted to be launched through the operation of an operating projection 70, as shown in FIG. 14.

The following is the description of the reconfiguration from the shape of a pistol into the shape of a robotic humanoid.

With the hammer 5 pulled rearwardly, the engagement between the hammer 5 and the gunstock section A is undone. Then, the supporting members 3, 6 are slid and pivoted with respect to each other, while the hammer 5 is locked in its rear position, as shown in FIGS. 2 and 3.

As shown in FIG. 3, the core member 21 is drawn out from the cylinder 2 to form the left arm.

The robotic humanoid head 31 is stood up, and the slide piece 30 is slid and rotated. In addition, the robotic humanoid head 31 is pushed so as to come in contact with the slide piece 30. The gunstock section A and gunbarrel section B are separated from each other.

Figure 13:
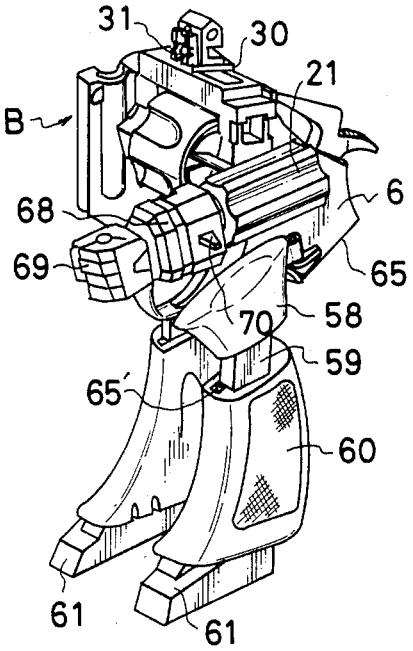
FIG. 13 is a perspective view of the embodiment in the unfolded state.

The front-side member 41 is folded over the base-side member 42 to form the right arm, as shown in FIG. 13.

After the bodies 60 come out of contact with respect to the covers 58, the covers 58, 58 are moved so as to expand from each other obliquely forward of the supporting member 6, and the covers 58 and the bodies 60 are separated from each other to form the legs, respectively. In addition, the foot 61 is projected from the underside of each leg, as shown in FIGS. 10 and 11.

The reconfiguration from the shape of the robotic humanoid into the shape of the pistol is effected by the operations conducted in an order reverse to the above.

It is to be noted that it is convenient to additionally provide projecting, recessed or inclined surfaces for constituting the following various surfaces; retainer surfaces for maintaining shape retention in the state where one variation is completed when the assembly is in the pistol or robotic humanoid state; stopper surfaces for regulating the change of an ideal shape when the form is changed; and guide surfaces for smoothing the reconfiguration. For example, as retainer portion for retaining the folded shape of the front-side member 41 and the base-side member 42, a pair of wall members may be projected from the upper side of the muzzle to clamp the part of the base-side member 42 opposing to the wall members, or another retainer member may be properly added. Moreover, it is possible to provide a regulating surface for regulating a given stop position or pivoting angle of each shaft sliding along the associated guide bore.

Further, as the fitting projections and recesses, fitting members may be constituted, according to the construction, by making use of the constituent members when the assembly is in the pistol or robotic humanoid state, in addition to the provision of members employed merely as fitting projections and recesses. In such a case, the positions of each projection and the associated recess (the same is the case with each guide bore and the associated slide shaft) are selected relatively to each other at the connection therebetween.

In addition to the above-described embodiment, it is possible to reverse the front and rear sides or the right and left sides of the robotic humanoid, and it is also possible to form each part by attaching or detaching separate pieces. In such a case, when a detachable fitting portion is formed by an uneven portion, it is preferable to form a lock surface which can be easily inserted in the direction for connection but cannot be drawn out in the direction for draw unless it is pulled by a force more than a predetermined value.

According to the invention, the various parts of the toy assembly forming the shape of a toy gun when folded are changed to those constituting a toy robotic humanoid when unfolded. It is thus possible to reconfigure, as desired, the toy robotic humanoid into the gun by folding the various parts and vice versa by unfolding the parts. Therefore, a toy assembly of the invention is very interesting and high in unexpectedness as a toy assembly. Moreover, since the toy assembly is constituted by the various parts, which are connected to each other, it is easy to handle the parts. In addition, it is possible to enjoy the configurations of both the gun and the robotic humanoid. Further, in operation for reconfiguration, the toy assembly can contribute to the development of intellectual faculties and the training of fingers. Accordingly, the invention offers a variety of effects demanded for a toy assembly, not to mention economy.

What is claimed is:

1. In a toy gun having a gunbarrel with a muzzle, and a gunstock provided with a rear sight, a cylinder and a grip, a toy gun comprising:

the gunbarrel foldably provided so as to constitute one of a robotic humanoid arms;

the cylinder adapted to constitute a robotic humanoid breast and drawably fitted with a core member;

the core member adapted to be movable so as to constitute the other robotic humanoid arm;

the grip pivotally attached so as to be splitable and unfoldable into two to constitute a pair of robotic humanoid legs; and the rear sight slidably as well as rotatably provided on the gunstock so as to constitute a robotic humanoid head;

wherein the toy gun is able to take a robotic humanoid configuration when unfolded.

2. A combination toy gun and robot assembly that can be reconfigured from one configuration to another configuration at the option of the user comprising:

a handle member;

a cylinder member;

a gun barrel member positioned adjacent the cylinder member;

a trigger assembly positioned adjacent the handle member and beneath the cylinder member, the handle member, cylinder member, gun barrel member and trigger assembly simulating the configuration of a gun in a first position, and a robotic head member connected to the and cylinder member, the handle member being configured to simulate the robotic legs of a humanoid robot when moved to a second position, a portion of the gun barrel member being configured to simulate a robotic arm of a humanoid robot, and a portion of the cylinder member being configured to simulate the other robotic arm when moved to a second position with the robotic head positioned adjacent the robotic arms and above the robotic legs wherein a toy robotic humanoid assembly can be provided in the second position by reconfiguration of the toy gun configuration.

3. The invention of claim 2 wherein the handle member is bifurcated into a pair of leg members.

4. The invention of claim 3 wherein each leg member includes a foot member that can be extended or retracted.

5. The invention of claim 4 wherein each leg member includes an upper and lower leg portion that is relatively slidable to enable a compact handle configuration or an extended robot leg configuration.

6. The invention of claim 5 wherein the upper leg portions are pivotally mounted adjacent the trigger assembly to permit rotation of the leg members.

7. The invention of claim 2 wherein the gun barrel member is bifurcated to provide the robotic arm.

8. The invention of claim 2 wherein the robotic head is mounted adjacent the cylinder member.

9. The invention of claim 2 wherein the handle member, gun barrel member, cylinder member, and trigger assembly are configured to simulate a Smith and Wesson 44 caliber pistol in the first position.

* * * * *